US010967424B2

(12) United States Patent
Kamiyama et al.

(10) Patent No.: US 10,967,424 B2
(45) Date of Patent: Apr. 6, 2021

(54) CASTING MOLD AND MANUFACTURING METHOD OF CAST PART

(71) Applicant: Marelli Corporation, Saitama (JP)

(72) Inventors: Naohisa Kamiyama, Saitama (JP); Tetsuzo Nishimura, Ueda (JP); Makoto Murakami, Ueda (JP); Ikuo Kataoka, Ueda (JP); Shinya Sato, Ueda (JP); Takaaki Ikari, Tokyo (JP)

(73) Assignee: Marelli Cabin Comfort Japan Corporation, Saitama (JP)

( * ) Notice: Subject to any disclaimer, the term of this patent is extended or adjusted under 35 U.S.C. 154(b) by 0 days.

(21) Appl. No.: 16/634,435

(22) PCT Filed: Jul. 25, 2018

(86) PCT No.: PCT/JP2018/027979
§ 371 (c)(1),
(2) Date: Jan. 27, 2020

(87) PCT Pub. No.: WO2019/022166
PCT Pub. Date: Jan. 31, 2019

(65) Prior Publication Data

US 2020/0164427 A1 May 28, 2020

(30) Foreign Application Priority Data

Jul. 28, 2017 (JP) ..... JP2017-146978

(51) Int. Cl.

| | |
|---|---|
| ***B22D 19/00*** | (2006.01) |
| ***B22D 17/22*** | (2006.01) |
| ***B22C 9/08*** | (2006.01) |
| ***B22C 9/06*** | (2006.01) |

(52) U.S. Cl.
CPC ..... *B22C 9/08* (2013.01); *B22C 9/06* (2013.01); *B22D 17/22* (2013.01); *B22D 19/00* (2013.01); *B22D 19/0063* (2013.01)

(58) Field of Classification Search
CPC .... B22D 19/00; B22D 19/0063; B22D 17/22; B22C 9/06; B22C 9/08
See application file for complete search history.

(56) References Cited

U.S. PATENT DOCUMENTS 4,066,115 A * 1/1978 Ohtani ..... B22D 19/0063 164/333
2018/0252432 A1 9/2018 Ogasawara et al.

FOREIGN PATENT DOCUMENTS

| | | | |
|---|---|---|---|
| JP | S47-030053 U | | 12/1972 |
| JP | S62-28058 A | | 2/1987 |
| JP | H02-48266 U | | 4/1990 |
| JP | H03-142057 A | | 6/1991 |
| JP | 2000254768 A | | 9/2000 |
| JP | 2002090077 A | * | 3/2002 |
| JP | 2008-229708 A | | 10/2008 |

(Continued)

*Primary Examiner* — Kevin E Yoon
(74) *Attorney, Agent, or Firm* — Young Basile Hanlon & MacFarlane, P.C.

(57) ABSTRACT

The heater (structure) has the gaps facing the molding wall portion of the casting mold. The casting mold is provided with: the molding wall portion forming the internal space; and the gap-portion filling ports (filling ports) that open to portions of the molding wall portion facing the gaps of the heater and that allow the molten metal to flow into the internal space.

4 Claims, 12 Drawing Sheets

(56) References Cited

FOREIGN PATENT DOCUMENTS

| | | | | | |
|---|---|---|---|---|---|
| JP | 2011-247545 | A | | 12/2011 | |
| JP | 2017-053615 | A | | 3/2017 | |
| JP | 2018-124022 | A | | 8/2018 | |
| WO | WO-2006001951 | A2 | * | 1/2006 | ..... B29C 48/832 |

* cited by examiner

CASTING MOLD AND MANUFACTURING METHOD OF CAST PART

CROSS-REFERENCE TO RELATED APPLICATION

The present application claims priority to Japanese Patent Application No. 2017-146978 filed on Jul. 28, 2017, the entire disclosure of which is incorporated herein by reference.

TECHNICAL FIELD

The present invention relates to a casting mold for molding a cast part and a manufacturing method of the cast part.

BACKGROUND

JP47-30053U discloses a heat exchanger in which a spiral pipe, through which fluid flows, and a heat generating sheathed heater are cast into a cast part.

In the manufacture of this type of heat exchanger, structures such as the pipe and the sheathed heater are installed in a casting mold, before a molten metal is filled into the casting mold. The molten metal thus filled is solidified to form the cast part. The cast part taken out from the casting mold includes built-in pipe and sheathed heater.

SUMMARY

However, when the above-mentioned cast part is formed by, for example, a die casting method, there is a risk in that, as the molten metal injected into the casting mold at high speed hits the structure, the structure such as the pipe, etc. may be deformed.

An object of the present invention is to prevent deformation of a structure cast into a cast part.

According to an aspect of the present invention, there is provided a casting mold for molding a cast part by filling molten metal into an internal space in which a structure having a gap is installed, the casting mold comprising: a molding wall portion forming the internal space; and a filling port opens to a portion of the molding wall portion facing the gap of the structure, the filling port being configured to allow the molten metal to flow into the internal space.

In addition, according to an aspect of the present invention, there is provided a manufacturing method of a cast part for molding the cast part by filling molten metal into an internal space of a casting mold in which a structure having a gap is installed, wherein the casting mold is provided with a molding wall portion forming the internal space; and a filling port opens to a portion of the molding wall portion facing the gap of the structure, and the manufacturing method comprising a filling step of allowing the molten metal to flow into the internal space through the filling port.

According to the above-described aspect, the molten metal flow injected against the gap from the filling port flows into the internal space through the gap. With such a configuration, the high-speed molten metal flow is suppressed from hitting the structure, and therefore, the deformation of the structure due to the load applied by the molten metal flow is prevented.

DETAILED DESCRIPTION

Figure 1:
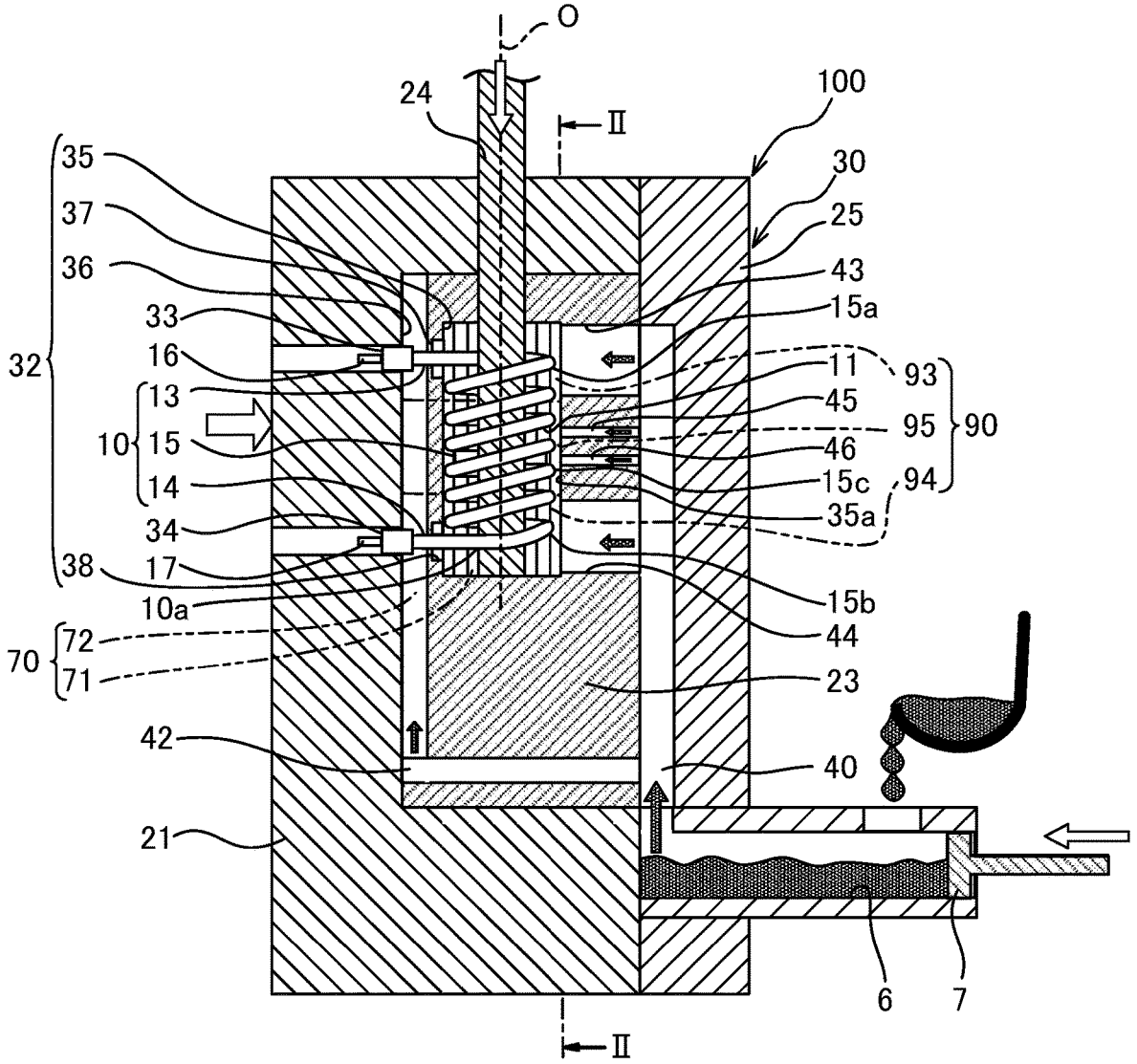
FIG. 1 is a vertical cross-sectional view showing a casting mold according to an embodiment of the present invention.

Embodiments of the present invention will be described below with reference to the attached drawings.

FIGS. 1 to 4 are cross-sectional views showing a casting device 100 to which a casting mold 30 according to the present embodiment is applied. For simplification of the description, a part of the casting device 100 is omitted in the drawing.

The casting device 100 for the die casting method is provided with a pressurizing part (piston) 7 for pressurizing a molten metal injected into an injection chamber 6 and the casting mold 30 forming an internal space 90 that is filled with the molten metal discharged from the injection chamber 6 by the pressurizing part 7. The molten metal is obtained by melting a metal such as an aluminum alloy, for example. As will be described later, in the mold 30, a cast part 70 is molded as the molten metal filled in the internal space 90 is solidified.

The casting mold 30 is provided with a fixed mold 25, and a movable mold 21, lateral slides 22 and 23, and a core 24 that are removed after molding. In the casting mold 30, the internal space 90 is formed as the movable mold 21, the lateral slides 22 and 23, and the core 24 are moved in the direction indicated by an outline arrow with respect to the fixed mold 25 and are held at predetermined positions.

In the internal space 90 of the casting mold 30, a heater 10 is installed as a structure to be cast into the cast part 70.

The heater 10 is a sheathed heater provided with a heat generating portion (not shown), which generates heat by energization, and a metal pipe (pipe) 10*a* for accommodating the heat generating portion. The heater 10 is not limited thereto, and may also be, for example, a PTC (Positive Temperature Coefficient) heater.

The heater 10 has end portions 13 and 14 serving as fixed portions supported by the casting mold 30 and a spiral extending portion 15 that extends from the end portions 13 and 14. Terminals 16 and 17 to which electrical wirings are connected are respectively provided at the distal ends of the end portions 13 and 14.

Figure 2:
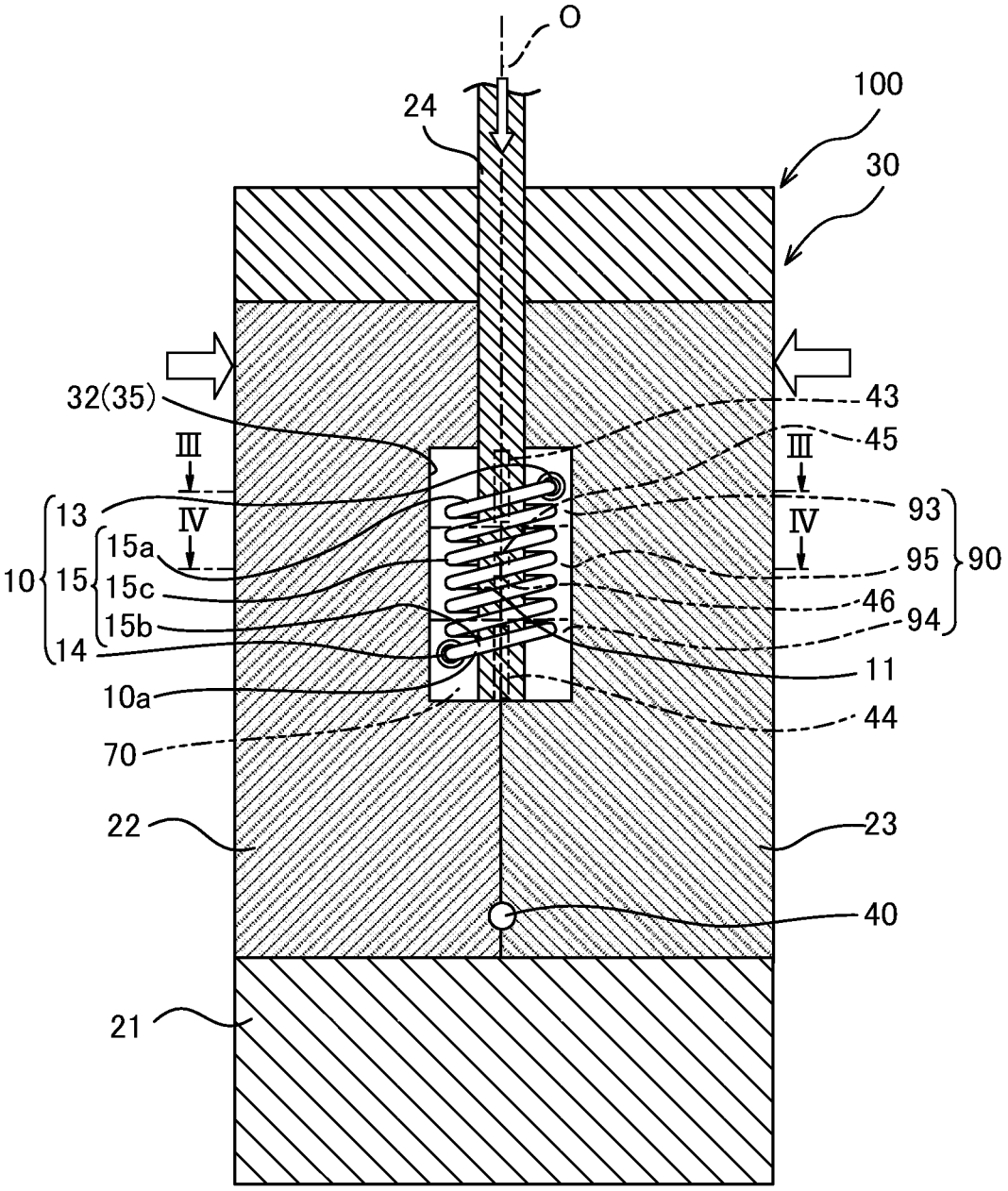
FIG. 2 is a longitudinal cross-sectional view taken along a line II-II in FIG. 1.
Figure 3:
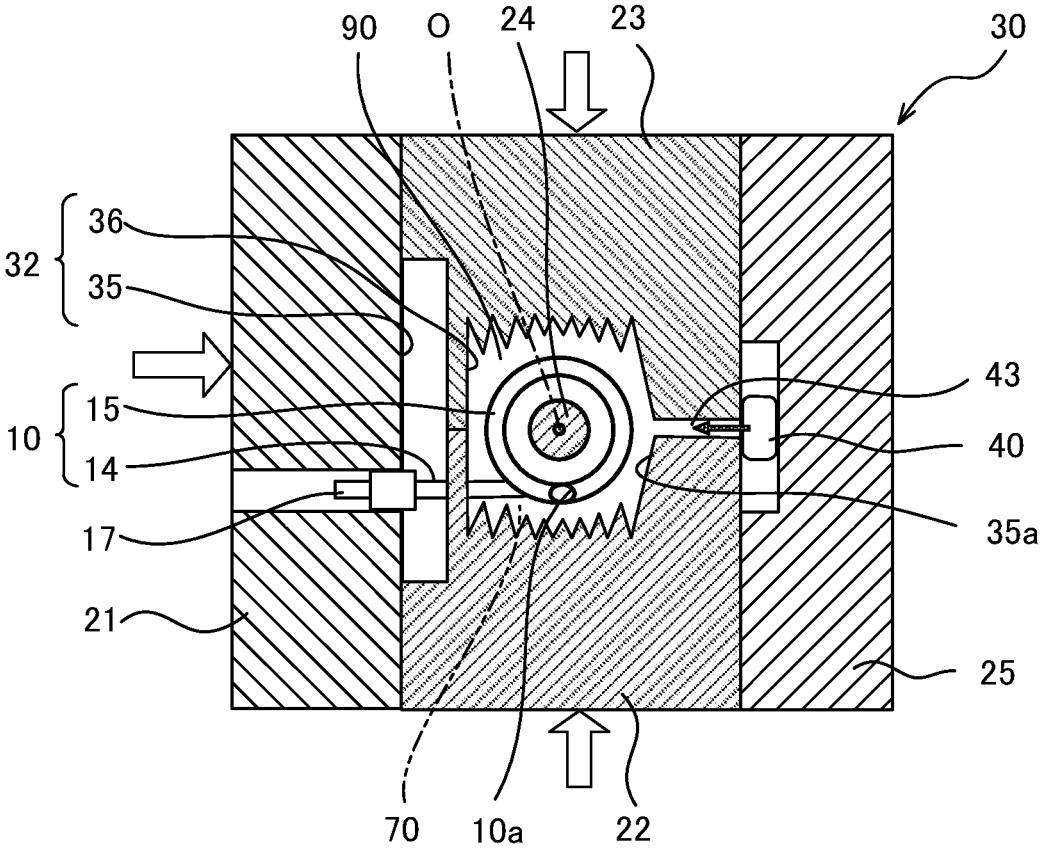
FIG. 3 is a lateral cross-sectional view taken along a line III-III in FIG. 2.
Figure 4:
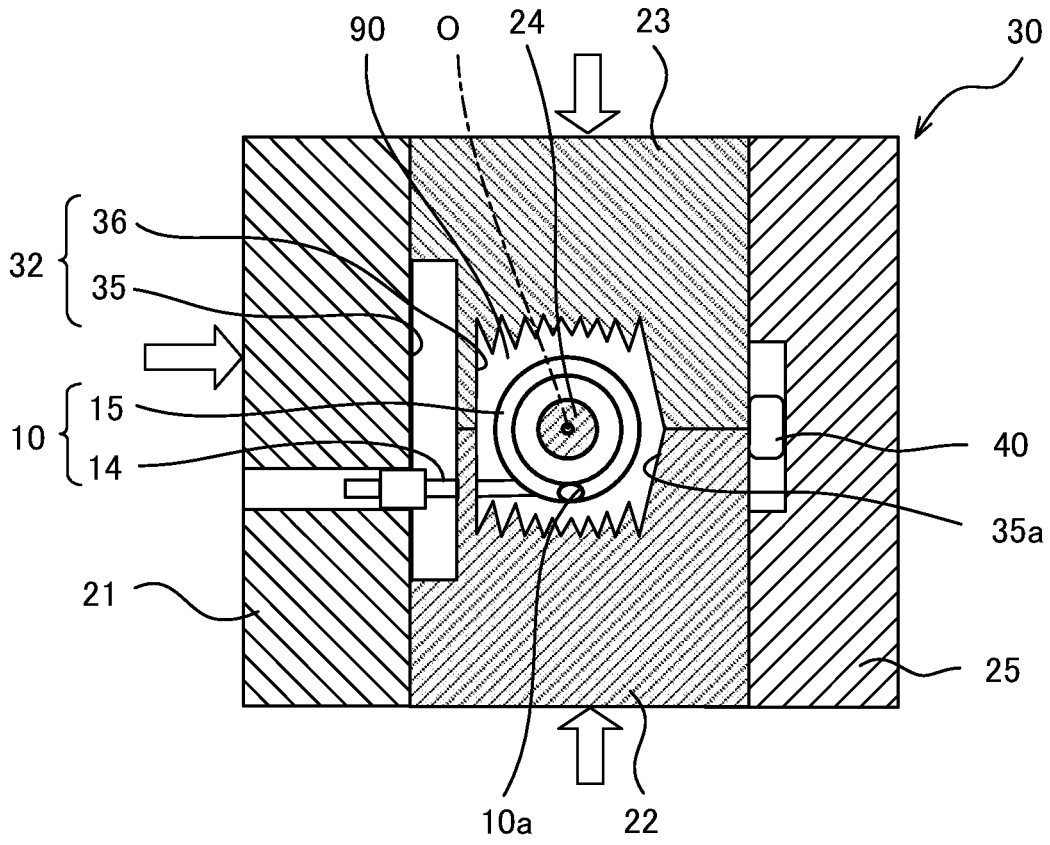
FIG. 4 is a lateral cross-sectional view taken along a line IV-IV in FIG. 2.

In the extending portion 15, the metal pipe 10*a* is spirally wound about the center line O. As shown in FIGS. 1 and 2, the metal pipe 10*a* is wound in the center line O direction such that gaps 11 are formed. As shown in FIG. 3, the metal pipe 10*a* is wound in a substantially circular ring shape when viewed from the center line O direction.

The two end portions 13 and 14 extend substantially in parallel with each other from both ends of the extending portion 15. As shown in FIG. 1, the end portions 13 and 14 are formed so as to be substantially perpendicular with respect to the center line O. As shown in FIG. 2, the end portions 13 and 14 are respectively located in the vicinities of two opposing corner portions in the internal space 90.

The cast part 70 has a cylindrical shaped cylinder portion 71, into which the extending portion 15 is cast, and a plate-like lid portion 72, into which the end portions 13 and 14 are cast. The cylinder portion 71 and the lid portion 72 are integrally formed. The cylinder portion 71 has a plurality of fins that protrude out from its outer surface. It should be noted that the cast part 70 may have a single block shape into which the extending portion 15 and the end portions 13 and 14 are cast, without having the lid portion 72.

The casting mold 30 has a molding wall portion 32 for molding the cast part 70 and hole-shaped supporting portions 33 and 34 for supporting the end portions 13 and 14 of the heater 10.

The molding wall portion 32 has a wall portion 35 for molding the cylinder portion 71, a wall portion 36 for molding the lid portion 72, and hole-shaped wall portions 37 and 38 for molding portions connecting the cylinder portion 71 and the lid portion 7.

The casting mold 30 has filling ports 42 to 46 that open to the internal space 90 and a runner 40 through which the injection chamber 6 is communicated with the internal space 90 through the filling ports 42 to 46.

The lower filling port 42 facing a lower portion of the internal space 90 opens to a lower end surface of the wall portion 36. The lid portion 72 of the cast part 70 is formed by the molten metal that is filled into the internal space 90 in the wall portion 36 from the lower filling port 42.

The filling ports 43 to 46 facing a side portion of the internal space 90 open to a side end surface 35*a* of the wall portion 35. The cylinder portion 71 of the cast part 70 is formed by the molten metal filled into the internal space 90 in the wall portion 35 from the filling ports 43 to 46.

Next, a process of casting the cast part 70 by the casting device 100 will be described.

First, an installation process of installing the heater 10 in the internal space 90 of the casting mold 30 is performed. In this installation process, the heater 10 is first assembled to the movable mold 21. At this time, the end portions 13 and 14 of the heater 10 are inserted into the hole-shaped supporting portions 33 and 34 through the hole-shaped wall portions 37 and 38, and thereby, the heater 10 is installed at a predetermined position in the internal space 90. Subsequently, the movable mold 21, the lateral slides 22 and 23, and the core 24 are set to the fixed mold 25, so as the internal space 90 to be formed.

Next, a filling step of filling the internal space 90 with the molten metal is performed. In this filling step, the internal space 90 is first filled with an active gas (oxygen). Next, the high-temperature molten metal is injected into the injection chamber 6, and the pressurizing section 7 is driven to pressurize the molten metal. As a result, the molten metal pushed out from the injection chamber 6 flows into the internal space 90 from the filling ports 42 to 46 through the runners 40, as indicated by arrows in FIG. 1. At this time, the molten metal is injected into the internal space 90 as a high-speed spray from the filling ports 42 to 46. As a result, in the internal space 90, a vacuum state is formed as the active gas is combined with the molten metal, and thereby, the molten metal is filled completely without forming a hollow space. Thus, formation of a cavity in the cast part 70 is prevented. It should be noted that the present invention is not limited to this, and for example, a gas vent hole may be formed in the casting mold 30 such that the air in the internal space 90 is discharged to the outside as the internal space 90 is filled with the molten metal.

Thereafter, in the casting mold 30, the molten metal filled in the internal space 90 is solidified to form the cast part 70. The movable mold 21, the lateral slides 22 and 23, and the core 24 are then separated from the casting component 70, so as the casting component 70 removed from the fixed mold 25.

As described above, the cast part 70 is manufactured. The cast part 70 with the built-in heater 10 is assembled to a tank (not shown) as a heater unit. In the heater unit, the heat generated by the heater 10 is transferred to a fluid (medium) circulating in the tank via the cast part 70 so as to heat the fluid.

Next, the arrangement of the heater 10 and the filling ports 43 to 46 with respect to the internal space 90 in the casting mold 30 will be described.

Figure 5:
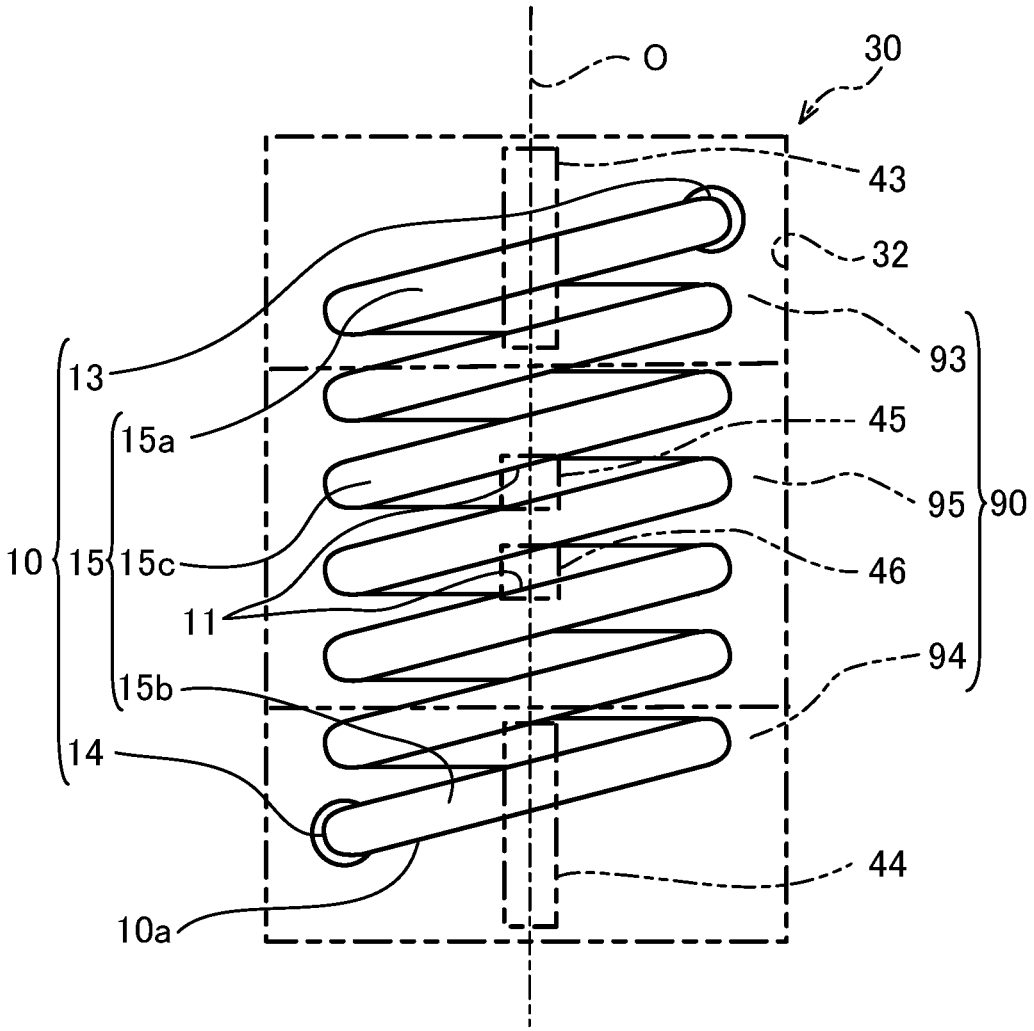
FIG. 5 is a diagram showing an arrangement of a heater and filling ports with respect to an internal space.

As shown in FIG. 5, the internal space 90 has an extending region 95 that is located at the center along the center line O direction (the vertical direction) and a supporting region 93 and a supporting region 94 that are located in a line so as to sandwich the extending region 95. The heater 10 is accommodated from the supporting region 93 to the extending region 95 and the supporting region 94.

The end portion 13 and a connecting portion 15*a* of the heater 10 are accommodated in one supporting region 93. The connecting portion 15*a* is a part of the extending portion 15 connected to the end portion 13.

A central portion 15*c* of the extending portion 15 of the heater 10 is accommodated in the center extending region 95.

The end portion 14 and a connecting portion 15*b* of the heater 10 are accommodated in other supporting region 94. The connecting portion 15*b* is a part of the extending portion 15 connected to the end portion 14.

The wall portion 35 and the filling ports 43 to 46 form a weir that guides the molten metal, which has been injected into the internal space 90, to predetermined positions.

The filling ports 43 to 46 are formed so as to be aligned in a line at positions facing the center portion of the heater 10 including the center line O (see FIG. 3). The filling ports 43 to 46 have substantially rectangular channel cross-sectional shapes and are formed to have dimensions in which the opening widths in the direction perpendicular to the center line O are substantially the same with each other.

It should be noted that the configurations of the filling ports 43 to 46 are not limited to those described above, and the filling ports 43 to 46 may be formed at positions not facing the center line O.

The supporting-portion filling port 43 facing the end portions 13 and 14 opens to the portion of the side end surface 35*a* of the molding wall portion 32 facing the supporting region 93. The supporting-portion filling port 43 is formed at a position in which its channel center line extends substantially in parallel with the end portion 13 of the heater 10 with a space therebetween.

The supporting-portion filling ports 43 and 44 are formed to have a slit shape in which the opening width in the center line O direction is larger than the opening width in the direction perpendicular to the center line O.

The supporting-portion filling port 43 is formed so as to face the connecting portion 15*a* of the extending portion 15 in the vicinity of the end portion 13 and to face a position offset with respect to the supporting portion 33. As shown in FIG. 3, the supporting-portion filling port 43 faces the center portion of the connecting portion 15*a* including the center line O.

With such a configuration, the molten metal injected from the supporting-portion filling port 43 flows along the end portion 13 of the heater 10 and flows into the central part of the supporting region 93.

The supporting-portion filling port 44 opens to the portion of the side end surface 35*a* facing the supporting region 94. The supporting-portion filling port 44 is formed at a position in which its channel center line extends substantially in parallel with the end portion 14 of the heater 10 with a space therebetween.

The supporting-portion filling port 44 is formed so as to face the connecting portion 15*b* of the extending portion 15 in the vicinity of the end portion 14 and to face a position offset with respect to the supporting portion 34. The supporting-portion filling port 44 faces the center portion of the connecting portion 15*b* including the center line O.

With such a configuration, the molten metal injected from the supporting-portion filling port 44 flows along the end portion 14 of the heater 10 and flows into the central part of the supporting region 94.

It should be noted that the configuration is not limited to that described, and the supporting-portion filling ports 43 and 44 may be formed at positions facing the vicinities of the corner portions in the internal space 90 so as to respectively face the supporting portions 33 and 34.

The gaps 11 in the heater 10 form a spiral shaped space formed between the metal pipe 10*a*, and have a portion facing the side end surface 35*a* of the molding wall portion 32. The gaps 11 are the gaps (spaces) facing the side end surface 35*a* of the molding wall portion 32.

Gap-portion filling ports 45 and 46 are formed at positions facing the gaps 11 in the heater 10. The gap-portion filling ports 45 and 46 are formed such that the respective channel center lines intersect the gaps 11.

In the center line O direction, the gap-portion filling ports 45 and 46 are formed such that the opening widths are shorter than the interval gap (pitch) at which the spiral metal pipe 10*a* is wound. The gap-portion filling ports 45 and 46 are formed at positions not facing the central part of the outer circumferential surface of the metal pipe 10*a*. With such a configuration, the molten metal flow injected into the extending region 95 from the gap-portion filling ports 45 and 46 flows into the internal space 90 through the gaps 11, and are suppressed from hitting the central part of the outer circumferential surface of the metal pipe 10*a*.

As described above, according to the present embodiment, there is provided the casting mold 30 provided with the filling ports 43 to 46 for filling the molten metal into the internal space 90 in which the heater 10 is installed.

When the molten metal is filled as described above, the molten metal in the form of a spray flows into the internal space 90 from the filling ports 43 to 46 at a speed of, for example, about 50 m/s.

Because the distance from the central portion 15*c* of the extending portion 15 to the supporting portions 33 and 34 is longer than the distances from the connecting portions 15*a* and 15*b* to the supporting portions 33 and 34, if the high-speed molten metal flow injected from the supporting-portion filling ports 43 and 44 hits the central portion 15*c*, the central portion 15*c* may be deformed.

As a countermeasure against such a problem, according to the present embodiment, the heater 10 (the structure) forms the gaps 11 that face the molding wall portion 32 of the casting mold 30. The casting mold 30 is configured so as to be provided with the molding wall portion 32 forming the internal space 90, and the gap-portion filling ports 45 and 46 (the filling ports) that open to portions of the molding wall portion 32 facing the gaps 11 and that allow the molten metal to flow into the internal space 90.

By being configured as described above, the molten metal injected against the gaps 11 from the gap-portion filling ports 45 and 46 flows into respective portions in the internal space 90 through the gaps 11. With such a configuration, the high-speed molten metal flow is suppressed from hitting the heater 10, and thereby, the deformation of the heater 10 due to the load applied by the molten metal flow is prevented. Because the molten metal flow smoothly flows into the internal space 90 through the gaps 11, the molten metal is completely filled into the respective portions in the internal space 90 without forming a hollow space. With such a configuration, with the cast part 70, the formation of the internal cavities is prevented and improvement in the quality is made possible.

In addition, according to the present embodiment, the casting mold 30 is configured so as to be provided with the supporting-portion filling ports 43 and 44 that open to the portions of the molding wall portion 32 facing the supporting regions 93 and 94.

The molten metal flow injected into the supporting regions 93 and 94 from the supporting-portion filling ports 43 and 44 hits the end portions 13 and 14 and the connecting portions 15*a* and 15*b* of the heater 10 at high speed. In the heater 10, the distance between the supporting portions 33 and 34 and the portion at which the high-speed molten metal flow hits is short, and therefore, bending stress caused by the molten metal flow is suppressed to the minimum. With such a configuration, with the heater 10, the strength against the load applied by the molten metal flow is ensured, and the deformation caused by the molten metal flow is prevented.

In addition, according to the present embodiment, the casting mold 30 is provided with the plurality of supporting portions 33 and 34. The heater 10 is configured to have the extending portion 15 that is provided so as to extend between the plurality of end portions 13 and 14.

By being configured as described above, the extending portion 15 of the heater 10 is supported by the plurality of end portions 13 and 14 at the both ends, and so, bending stress caused by the molten metal flow is suppressed to the minimum. With such a configuration, it is possible to effectively prevent the deformation of the heater 10.

Thus, according to the present embodiment, it is possible to provide the manufacturing method of the cast part 70 for manufacturing the cast part 70 into which the heater 10 is cast using the casting mold 30.

In addition, according to the present embodiment, it is possible to provide the manufacturing method of the cast part 70 for manufacturing the cast part 70 into which the spiral metal pipe 10*a* is cast as the structure installed in the internal space 90.

With such a configuration, in the heater unit, the shape of the spiral metal pipe 10*a* prone to be deformed is maintained, and the desired performance can be obtained.

Figure 6:
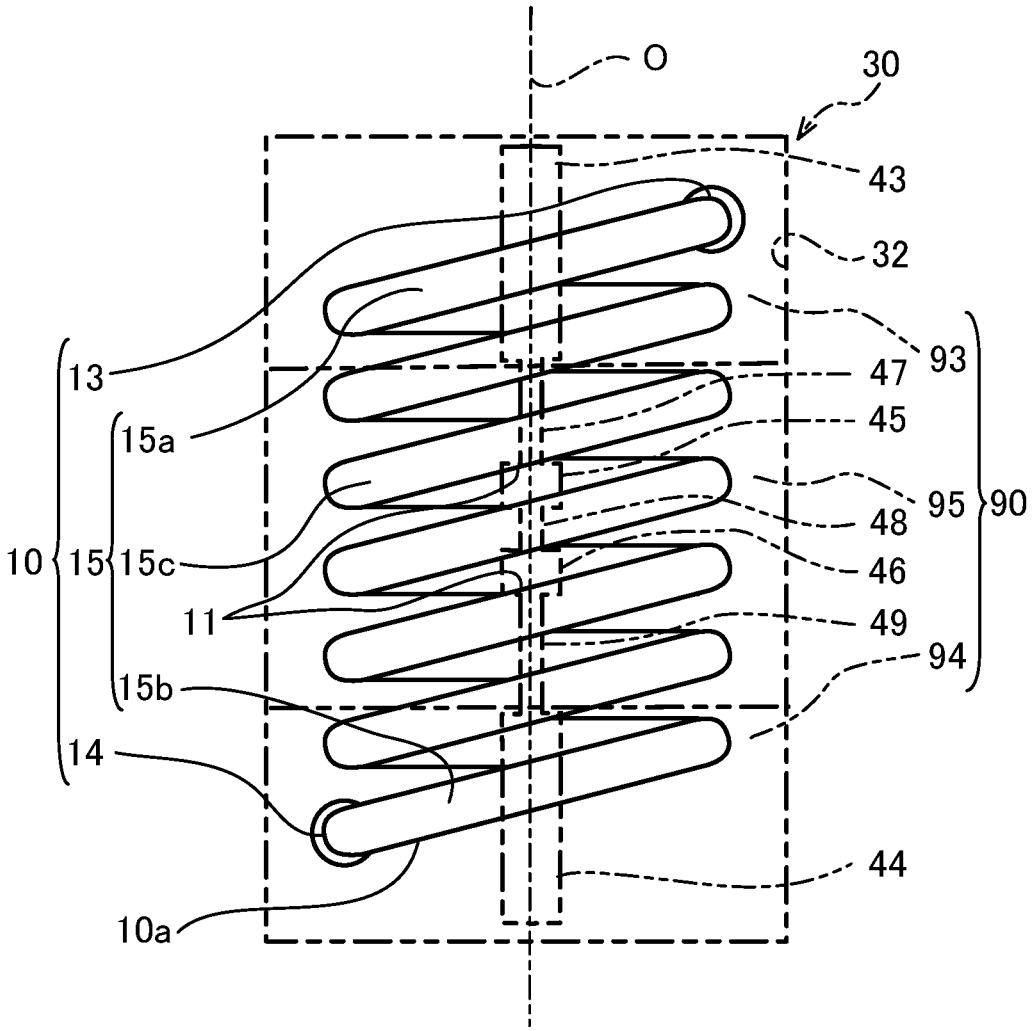
FIG. 6 is a diagram showing the arrangement of the heater and the filling ports with respect to the internal space in a modification of the casting mold.

Next, a modification of the casting mold 30 shown in FIG. 6 will be described.

The casting mold 30 has small filling ports 47 to 49 having smaller opening width than the filling ports 43 to 46. The small filling ports 47 to 49 open to portions of the molding wall portion 32 facing the heater 10. Through the small filling ports 47 to 49, the adjacent filling ports 43 to 46 are communicated to each other.

The small filling ports 47 to 49 are formed to have the slit shapes that open at positions aligned with the filling ports 43 to 46 in a line along the center line O. In the direction perpendicular to the center line O, the opening widths of the small filling ports 47 to 49 are smaller than the opening widths of the filling ports 43 to 46.

By being configured as described above, in the filling step, the molten metal flow injected from the small filling ports 47 to 49 is decelerated as the molten metal flow passes through the small filling ports 47 to 49 and resistance is imparted thereto. With such a configuration, the extending portion 15 of the heater 10 is prevented from being deformed by the molten metal flow injected from the small filling ports 47 to 49 and hitting the extending portion 15.

Next, a modification of the casting mold 30 shown in FIG. 7 will be described.

The casting mold 30 has gaps 61 and 62 between the end portions 13 and 14 of the heater 10 and both end wall surfaces 35*b* and 35*c* of the wall portion 35. The gaps 61 and 62 are the gaps (spaces) facing the side end surface 35*a* of the molding wall portion 32.

The casting mold 30 has gap-portion filling ports 51 to 58 that open at the side end surface 35*a*. The gap-portion filling ports 51 to 58 open so to respectively face the gap 61, each of the gaps 11, and the gap 62. The gap-portion filling ports 51 to 58 are formed so as to be aligned in a line at portions of the side end surface 35*a* facing the center portion of the heater 10 including the center line O.

Figure 7:
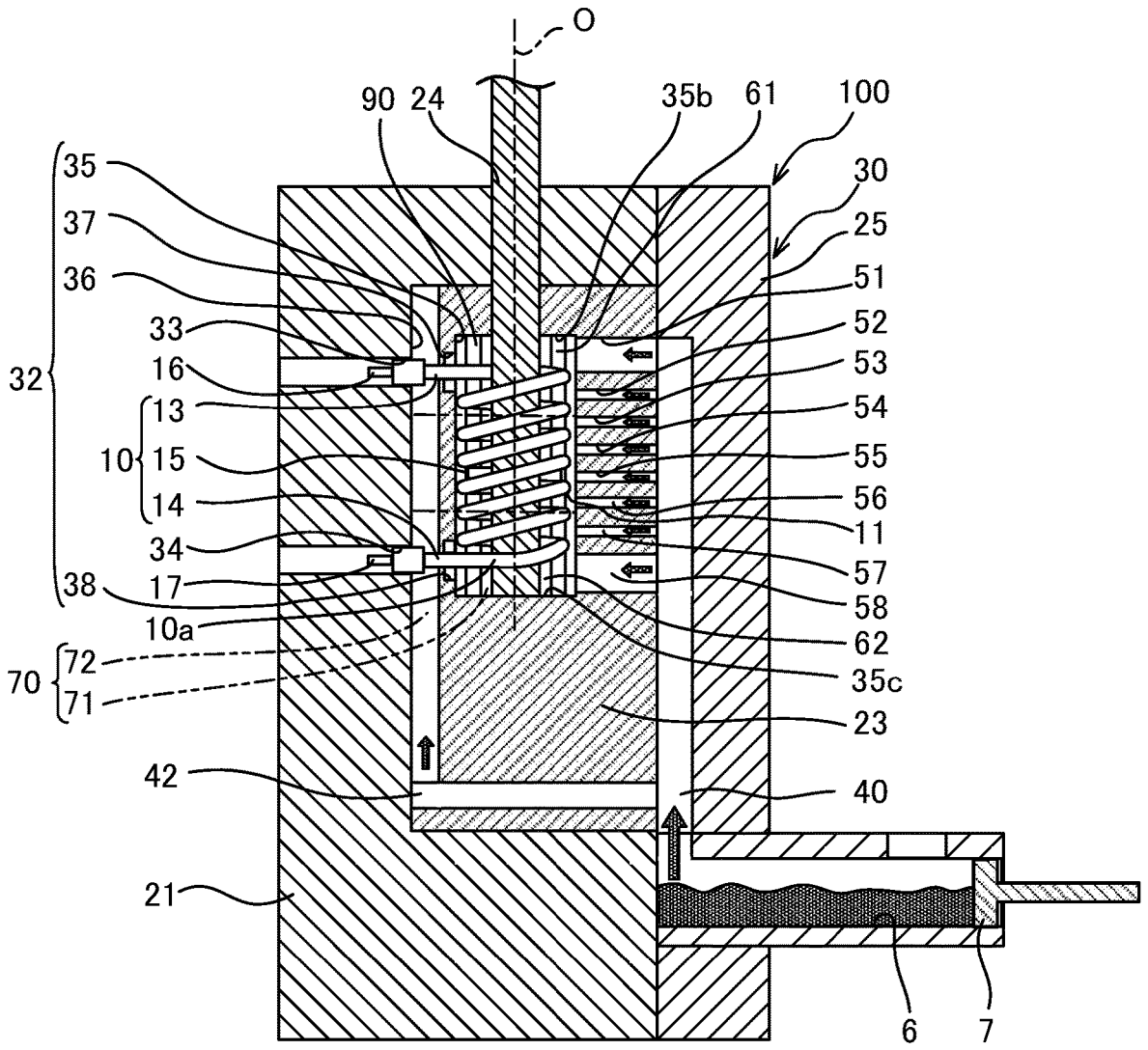
FIG. 7 is a longitudinal cross-sectional view showing another modification of the casting mold.

By being configured as described above, in the filling step, as shown by the arrows in FIG. 7, the molten metal supplied through the runner 40 is injected from the gap-portion filling ports 51 to 58 and flows into the respective portions in the internal space 90 through the gap 61, each of the gaps 11, and the gap 62. With such a configuration, in the heater 10, the high-speed molten metal flow is suppressed from hitting the heater 10, and so, the deformation caused by the molten metal flow is prevented.

Next, a modification of the casting mold 30 shown in FIG. 8 will be described.

The casting mold 30 has gaps 73 and 74 between the outer circumference of the heater 10 and the wall portion 35 of the molding wall portion 32. The gaps 73 and 74 are the gaps (spaces) facing the side end surface 35*a* of the molding wall portion 32.

The casting mold 30 has gap-portion filling ports 65 and 66 that open to portions of the side end surface 35*a* facing the gaps 73 and 74. The gap-portion filling ports 65 and 66 are formed so as to be inclined with respect to the center line P extending in the substantially horizontal direction perpendicular to the center line O and formed side by side so as to face the gaps 73 and 74.

Figure 8:
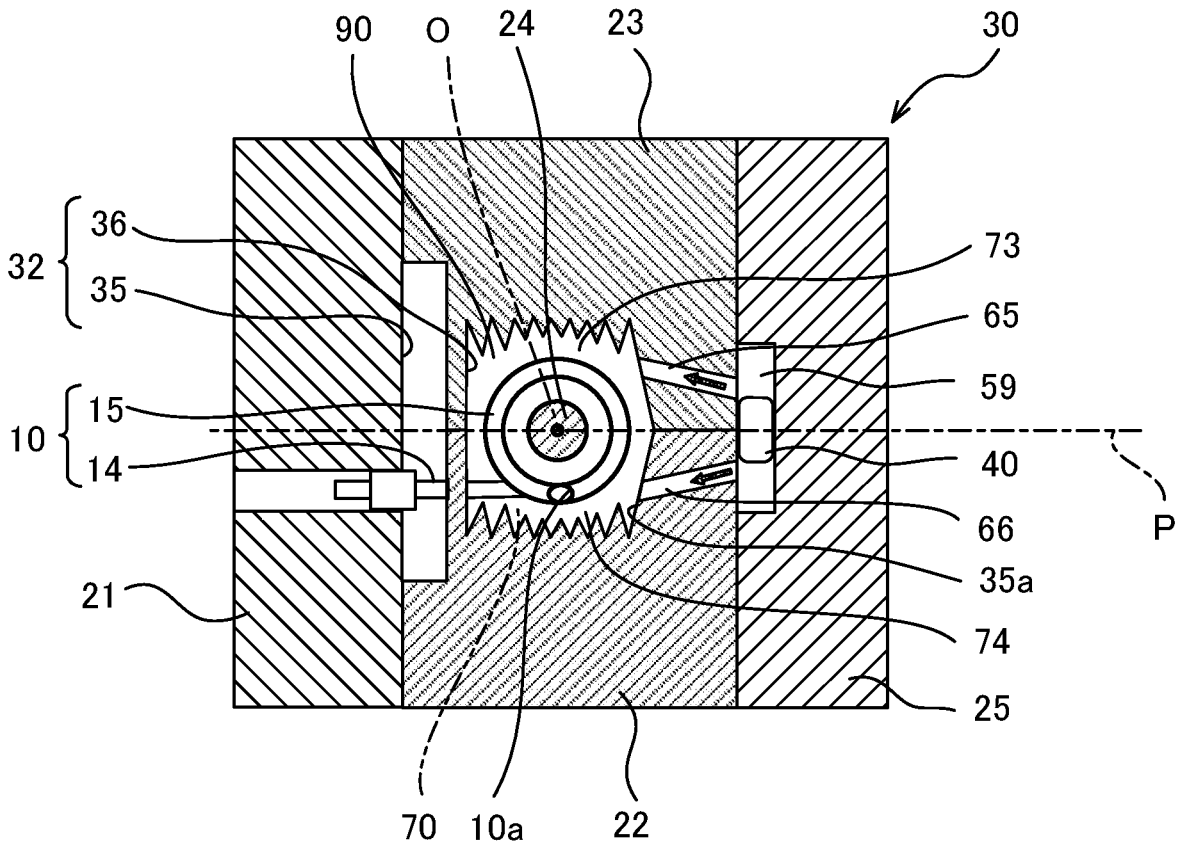
FIG. 8 is a lateral cross-sectional view showing still another modification of the casting mold.

By being configured as described above, in the filling step, as shown by the arrows in FIG. 8, the molten metal supplied through the runner 40 is injected from the gap-portion filling ports 65 and 66 and flows into the respective portions in the internal space 90 through the gaps 73 and 74. With such a configuration, in the heater 10, the high-speed molten metal flow is suppressed from hitting the heater 10, and so, the deformation caused by the molten metal flow is prevented.

The gap-portion filling ports 65 and 66 extend obliquely so as to separate away from each other from a chamber 59 of the runner 40 towards the internal space 90. With such a configuration, with the casting mold 30, a volume of the chamber 59 can be made smaller as compared with the casting mold 30 in which the gap-portion filling ports 65 and 66 are arranged such that the center lines are substantially in parallel. As a result, it is possible to reduce an amount of waste material after the molten metal is solidified in the chamber 59.

Next, modifications of the heater 10 and the casting mold 30 shown in FIGS. 9 and 10 will be described.

The extending portion 15 of the heater 10 has a zigzag shape in which the metal pipe 10*a* extends in zigzag in the cast part 70. The end portions 13 and 14 of the heater 10 extend substantially in parallel with each other from the both ends of the extending portion 15.

The extending portion 15 of the heater 10 has a plurality of gaps 76 facing the side end surface 35*a* of the molding wall portion 32. Gaps 75 and 77 are respectively formed between the end portions 13 and 14 of the heater 10 and the both end wall surfaces 35*b* and 35*c* of the molding wall portion 32. The gaps 75 to 77 are the gaps (spaces) facing the side end surface 35*a* of the molding wall portion 32.

The casting mold 30 has gap-portion filling ports 81 to 85 respectively facing the gaps 75 to 77 of the heater 10. The gap-portion filling ports 81 to 85 are formed so as to be aligned in a line.

Figure 9:
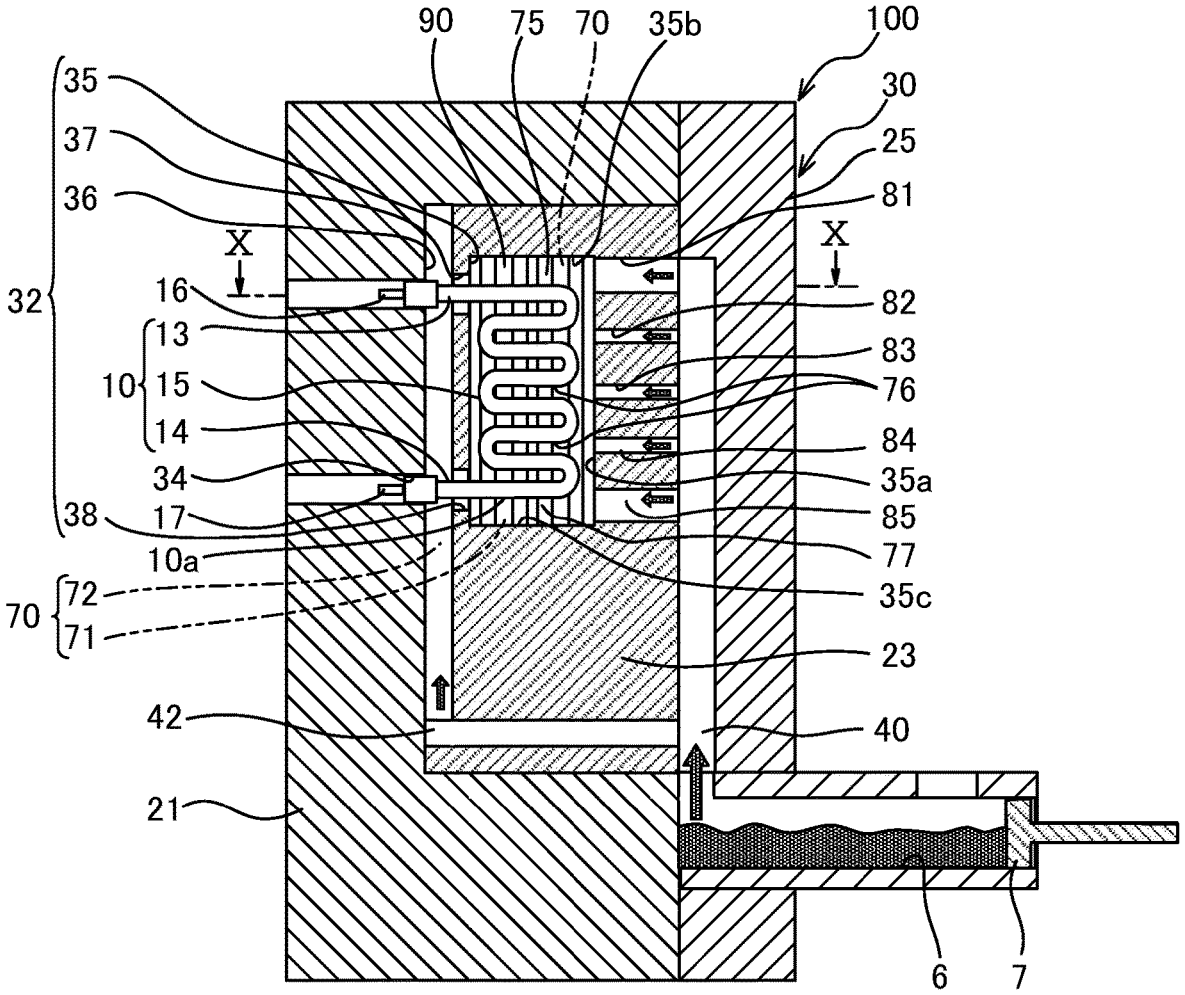
FIG. 9 is a longitudinal cross-sectional view showing still another modification of the casting mold.
Figure 10:
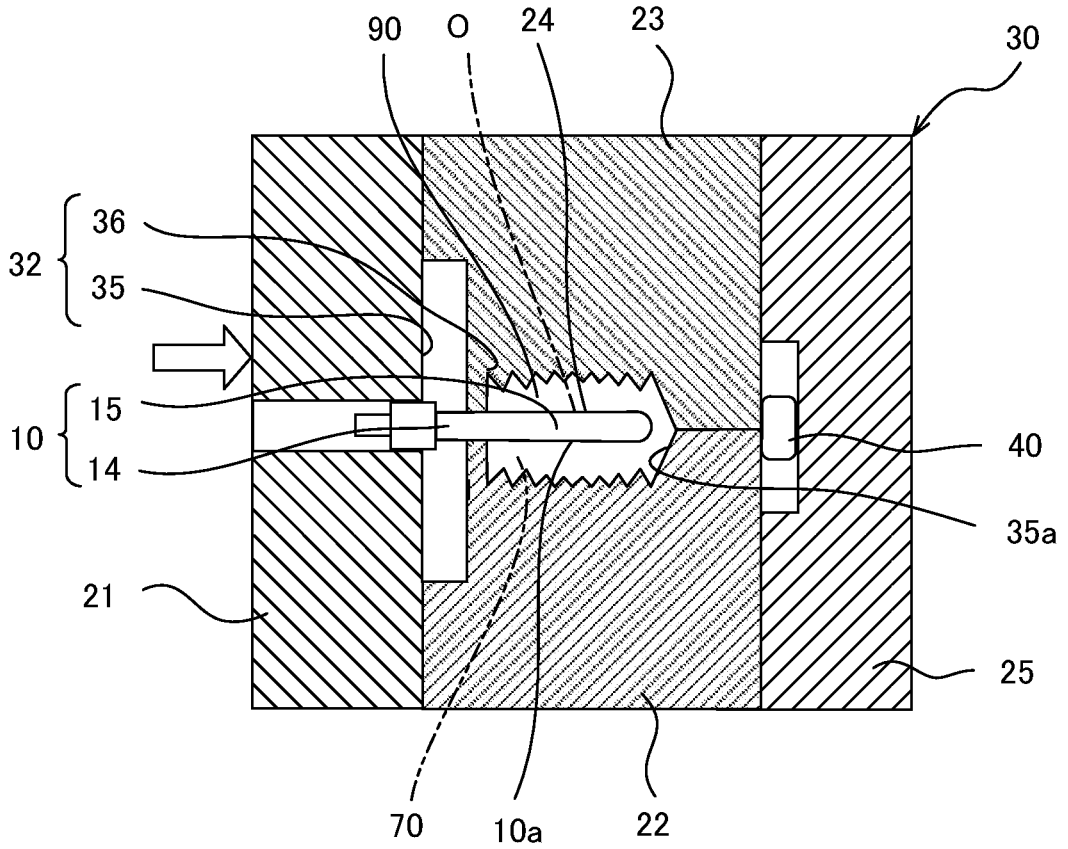
FIG. 10 is a lateral cross-sectional view taken along a line X-X in FIG. 9.

By being configured as described above, in the filling step, as shown by the arrows in FIG. 9, the molten metal supplied through the runner 40 is injected from the gap-portion filling ports 81 to 85 and flows into the respective portions in the internal space 90 through the gaps 75 and 76. With such a configuration, in the heater 10, the high-speed molten metal flow is suppressed from hitting the heater 10, and so, the deformation caused by the molten metal flow is prevented.

Next, a modification of the heater 10 and the casting mold 30 shown in FIGS. 11 and 12 will be described.

In the extending portion 15 of the heater 10, the metal pipe 10*a* is spirally wound about the center line P extending in the substantially horizontal direction. The extending portion 15 of the heater 10 has a gap 79 facing the side end surface 35*a* of the molding wall portion 32.

The end portions 13 and 14 of the heater 10 extend substantially in parallel with each other from the both ends of the extending portion 15. Gaps 78 and 80 are respectively formed between the end portions 13 and 14 of the heater 10 and the both end wall surfaces 35*b* and 35*c* of the molding wall portion 32.

The casting mold 30 has gap-portion filling ports 86 to 88 that open to portions respectively facing the gaps 78 to 80. The gap 78 and the gap-portion filling port 86, the gap 79 and the gap-portion filling port 87, and the gap 80 and the gap-portion filling port 88 are respectively formed side by side with respect to the center line P.

Figure 11:
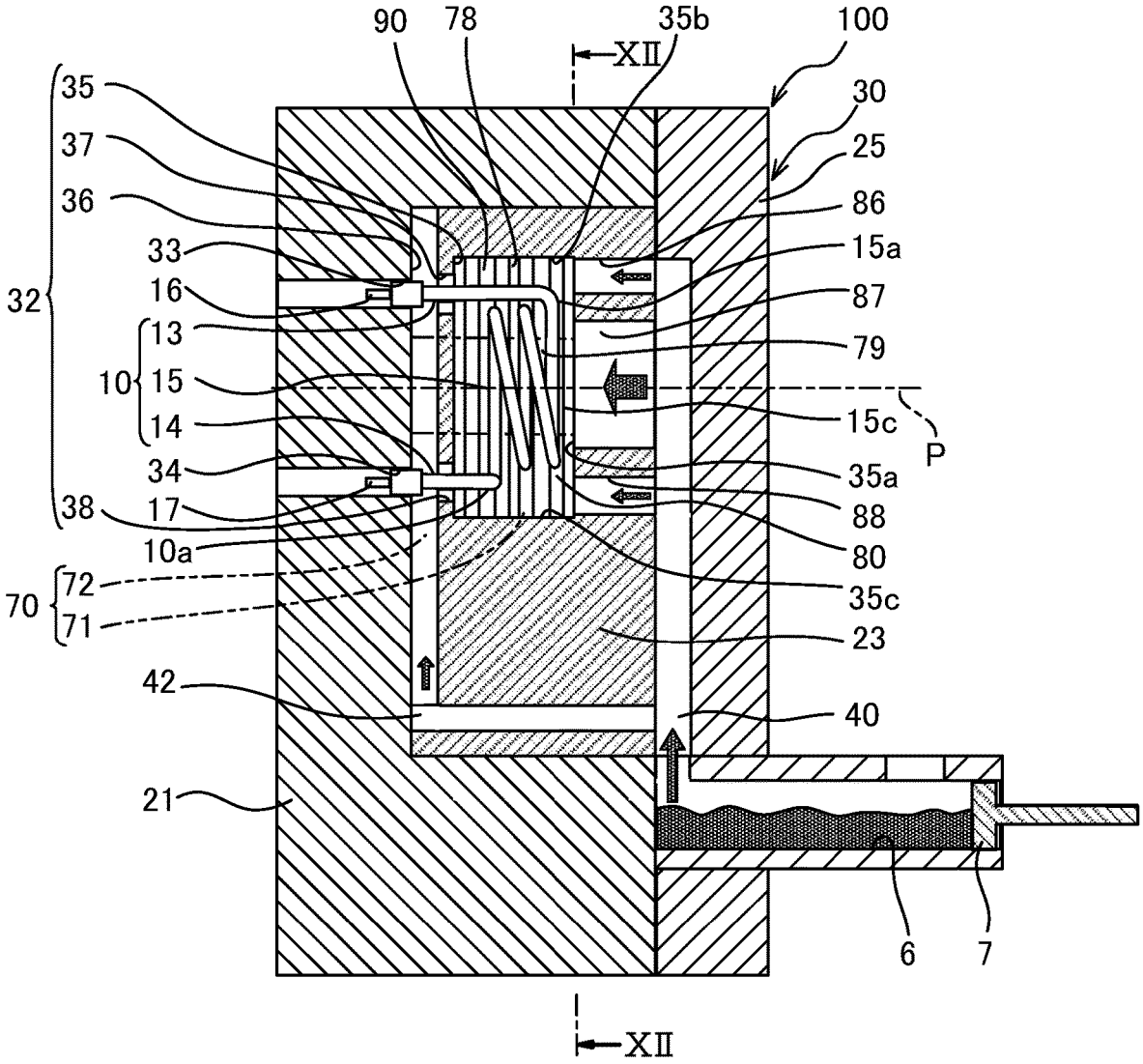
FIG. 11 is a longitudinal cross-sectional view showing still another modification of the casting mold.
Figure 12:
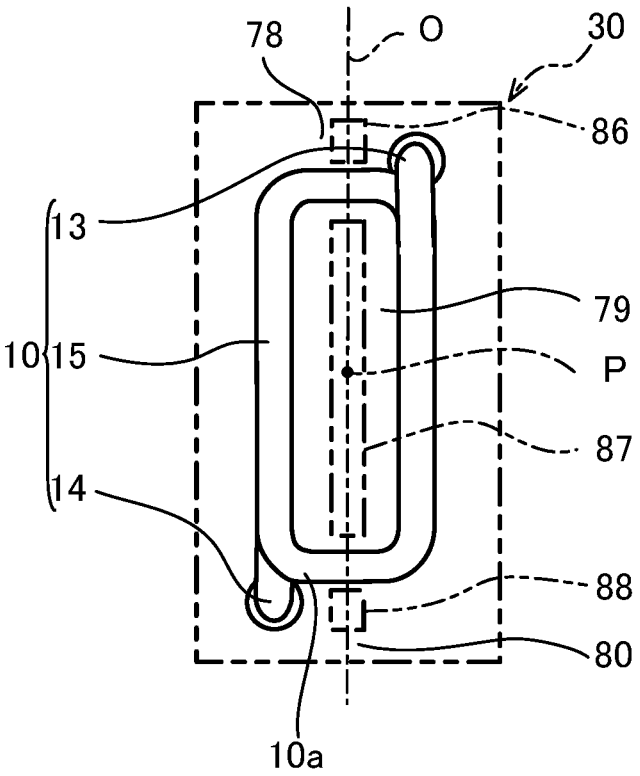
FIG. 12 is a lateral cross-sectional view taken along a line XII-XII in FIG. 11.

By being configured as described above, in the filling step, as shown by the arrows in FIG. 11, the molten metal supplied through the runner 40 is injected from the gap-portion filling ports 86 to 88 and flows into the respective portions in the internal space 90 through the gaps 78 to 80. With such a configuration, in the heater 10, the high-speed molten metal flow is suppressed from hitting the heater 10, and so, the deformation caused by the molten metal flow is prevented.

Embodiments of the present invention were described above, the above embodiments are merely examples of applications of this invention, and the technical scope of this invention is not limited to the specific constitutions of the above embodiments.

Although the present invention is suitable as the casting mold for casting the heater, it may also be applicable to the casting mold for casting the structure other than the heater.

Although the present invention is suitable as the casting method by the die casting method in which the molten metal is pressurized and filled into the casting mold, it may also be applicable to other casting methods.

The invention claimed is:

1. A casting mold for molding a cast part by filling molten metal into an internal space in which a structure to be cast is installed, wherein the casting mold has a molding wall portion configured to form the internal space, the structure has an extending portion and a pair of end portions serving as fixed portions, the pair of end portions being supported by the molding wall portion, the extending portion extending between the pair of end portions, the extending portion is formed to have a spiral shape and so as to form a gap in a direction of a center line of the spiral shape, the pair of end portions extend from both ends of the extending portion in a direction towards the molding wall portion so as to be substantially in parallel with each other and so as to be substantially perpendicular with respect to the center line, and a gap-portion filling port is provided so as to face the gap positioned at a central portion in the center line direction, and the molten metal is filled into the spiral interior of the extending portion through the gap-portion filling port.

2. The casting mold according to claim 1, wherein the gap-portion filling port is further provided with a filling port for filling the molten metal into the internal space through the filling port, the filling port being configured to open at between the end portion of the structure and both end wall surfaces, the both end wall surfaces being on both end sides of the molding wall portion in the direction of the center line of the spiral shape.

3. The casting mold according to claim 1, further comprising a supporting-portion filling port formed at position facing the end portion.

4. A manufacturing method of a cast part for molding the cast part by filling molten metal from a filling port into an internal space of casting mold in which a structure to be cast is installed, wherein, the casting mold has a molding wall portion forming the internal space, the structure has an extending portion and a pair of end portions serving as fixed portions, the pair of end portions being supported by the molding wall portion, the extending portion extending between the pair of end portions, the extending portion is formed to have a spiral shape and so as to form a gap in a direction of a center line of the spiral shape, the pair of end portions extend from both ends of the extending portion in a direction towards the molding wall portion so as to be substantially in parallel with each other and so as to be substantially perpendicular with respect to the center line, a gap-portion filling port is provided so as to face the gap positioned at a central portion in the center line direction, and the manufacturing method comprising a filling step of filling the molten metal into the spiral interior of the extending portion through the gap-portion filling port.

* * * * *